United States Patent [19]

Martinsons et al.

[11] 4,453,514

[45] Jun. 12, 1984

[54] ENGINE SPEED ADAPTIVE AIR BYPASS VALVE (DASHPOT) CONTROL

[75] Inventors: Robert Martinsons, Chicago; Robert W. Deutsch, Wheeling, both of Ill.

[73] Assignee: Motorola, Inc., Schaumburg, Ill.

[21] Appl. No.: 460,722

[22] Filed: Jan. 25, 1983

[51] Int. Cl.[3] ..... F02M 23/06

[52] U.S. Cl. ..... 123/327; 123/585

[58] Field of Search ..... 123/327, 328, 339, 371, 123/493, 585, 586

[56] References Cited

U.S. PATENT DOCUMENTS

| | | | |
|---|---|---|---|
| 4,237,842 | 12/1980 | Fukuhara et al. | 123/585 |
| 4,306,527 | 12/1981 | Kinugawa et al. | 123/327 |
| 4,347,699 | 9/1982 | Kitamura | 123/327 |
| 4,355,606 | 10/1982 | Casey | 123/327 |
| 4,359,993 | 11/1982 | Carlson | 123/493 |

*Primary Examiner*—William A. Cuchlinski, Jr.

*Attorney, Agent, or Firm*—Phillip H. Melamed; James S. Pristelski; James W. Gillman

[57] ABSTRACT

During engine cranking and after cranking if engine coolant temperature has not yet exceeded a minimum value, an air bypass valve (dashpot) provides maximum additional air to the engine fuel mixture in addition to the air provided in accordance with engine throttle position. During normal engine run conditions with the throttle not effectively closed, the dashpot provides minimum additional air to the fuel mixture. During deceleration when engine throttle is effectively closed, if engine speed is at least a maximum speed IDLEH and then declines, effective dashpot actuation will be 100% (maximum additional air) for engine speeds at least equal to IDLEH, 0% for engine speeds below a minimum speed IDLEL, and for engine speeds between IDLEH and IDLEL, the change (decrease) in dashpot actuation will be proportional to the change in current engine speed and substantially independent of time. If during deceleration engine speed decreases to IDLEL, then dashpot actuation remains at a minimum.

21 Claims, 7 Drawing Figures

ENGINE SPEED ADAPTIVE AIR BYPASS VALVE (DASHPOT) CONTROL

BACKGROUND OF THE INVENTION

The present invention relates generally to the field of engine fuel mixture control apparatus and more particularly to the field of controlling the amount of air added to the engine fuel mixture by an air bypass valve (dashpot) which adds additional air to the fuel mixture in addition to the amount of air in the fuel mixture determined in accordance with engine throttle position.

It is known that during engine deceleration, defined herein as occurring in response to the abrupt effective closure of the engine throttle and corresponding to the release of pressure from the gas pedal for standard automotive gasoline engines, it is typically desirable to add additional air to the engine fuel mixture to encourage the vaporization of excess fuel such as gasoline during the deceleration transient. After the deceleration transient, the engine speed will arrive at a steady state "idle" speed corresponding to the existing engine load condition with the engine throttle effectively closed and no additional air being supplied by the air bypass valve. This corresponds to a minimum effective actuation of the dashpot. The additional air supplied during deceleration is required to minimize hydrocarbon emissions produced by the engine in response to the engine attempting to operate on too rich of a fuel mixture.

Prior engine fuel mixture control systems noted that additional air should be provided during engine deceleration and that the amount of this additional air should be decreased to zero after the deceleration transient when the engine was operating at its final idle speed. These prior systems implemented this function by providing for full dashpot actuation during deceleration for engine speeds above some maximum predetermined engine speed threshold level, and then, as the engine speed decreased below this level, gradually decreasing the degree of dashpot actuation as a fixed function of elapsed time or as a fixed function of an elapsed number of engine revolutions. In these prior systems the rate of decrease of dashpot actuation is primarily determined by the elapsed time which occurs once the engine speed has decreased below the maximum predetermined engine speed level. It should be noted that the number of engine revolutions is actually a product function of engine speed and elapsed time, and is primarily a function of time during such decelerations.

While such engine fuel mixture control systems as those described above are feasible, the present invention has recognized that controlling the degree of dashpot actuation primarily in accordance with elapsed time during deceleration does not provide the desired amount of dashpot actuation decrease under various different engine deceleration conditions.

SUMMARY OF THE INVENTION

An object of the present invention is to provide an improved engine fuel mixture control apparatus in which during engine deceleration the degree of effective dashpot actuation is varied more directly in accordance with engine operational parameters.

In one embodiment of the present invention an engine fuel mixture control apparatus is provided for controlling the effective on time (actuation) of an air bypass valve (dashpot) which adds additional air to the fuel mixture during engine deceleration, in addition to the air determined by the actual throttle position. This control apparatus comprises: sensor means for sensing the occurrence of engine deceleration and providing a deceleration occurrence signal in response thereto; generator means for generating an engine speed signal having a magnitude corresponding to current engine speed; and control means coupled to both said deceleration sensor means and said engine speed generator means for receiving said deceleration occurrence signal and said engine speed signal, and for controlling in response thereto, during engine deceleration, the change in the effective degree of actuation of said air bypass valve substantially independently of the time duration of deceleration but substantially in proportion with the change of the magnitude of said engine speed signal.

More particularly, the present invention has recognized that the rate of decrease of engine speed during engine deceleration varies greatly depending upon various engine conditions such as the transmission gear the engine was operating in prior to the onset of engine deceleration. Thus the present invention has noted that since the rate of decrease of engine speed can vary greatly during deceleration depending upon various engine conditions, that a fixed function time dependent decrease in the effective degree of dashpot actuation during deceleration does not adequately implement the desired decrease in dashpot actuation as a function of actual engine operating conditions. The present invention recognizes this and makes the magnitude of the current engine speed during deceleration the primary determining variable in controlling the rate of decrease of engine dashpot actuation during deceleration regardless of the elapsed time of the engine deceleration condition. This has been found to improve the operation of the engine by reducing hydrocarbon emissions and matching the decrease of the actuation of the dashpot during deceleration more closely to actual engine operating conditions.

The present invention utilizes a speed sensor which senses the passage of crankshaft driven projections and develops an engine speed control signal RPM. An engine throttle position sensor means, which can comprise merely an engine throttle switch, provides a signal that indicates when the engine throttle is effectively closed. By monitoring other engine conditions such as whether or not the engine is cranking (operated in the initial start mode and therefore having an extremely low engine speed), whether the radiator coolant (water) temperature has exceeded some minimum threshold value $K_1$ and whether or not engine speed has obtained some maximum threshold value IDLEH at which full dashpot actuation should occur in the event of deceleration, the present invention implements varying the effective duty cycle of a pulse width modulated excitation signal for the dashpot. More specifically, during a detected engine deceleration condition and between predetermined engine speeds of IDLEH and IDLEL the change in the degree of actuation of the air bypass valve will be in direct proportion to the change in engine speed and the magnitude of dashpot actuation will depend upon the magnitude of the current engine speed and be independent of the elapsed time during which engine deceleration exists.

Preferably, the degree of dashpot actuation provided by the present invention for any engine speed is always lower than the actuation amount which would be required by the air bypass valve to maintain that same engine speed as the no load engine idle speed. In other words, the control apparatus of the present invention contemplates having engine speed control the duty cycle of the dashpot rather than having the dashpot duty cycle determine the engine speed. In this manner a smooth deceleration between IDLEH and IDLEL is provided while proportionally decreasing the actuation of the dashpot in accordance with engine speed without arriving at a condition where a steady state engine idle condition is arrived at therebetween.

An additional feature of the present invention is controlling the decrease in the degree of actuation of the dashpot in proportion to engine speed by the control means only if engine speed during the engine deceleration condition exceeds the predetermined engine speed IDLEH and then decreases. Another feature is that the control apparatus includes circuitry for providing for constant minimum effective actuation of the dashpot once engine speed falls below a predetermined minimum speed IDLEL during engine deceleration, unless engine speed thereafter exceeds the maximum engine speed IDLEH. These and other features of the present invention are more fully explained in connection with the detailed description of the preferred embodiments.

BRIEF DESCRIPTION OF THE DRAWINGS

For a more complete understanding of the present invention, reference should be made to the drawings, in which.

DESCRIPTION OF THE PREFERRED EMBODIMENTS

Figure 1:
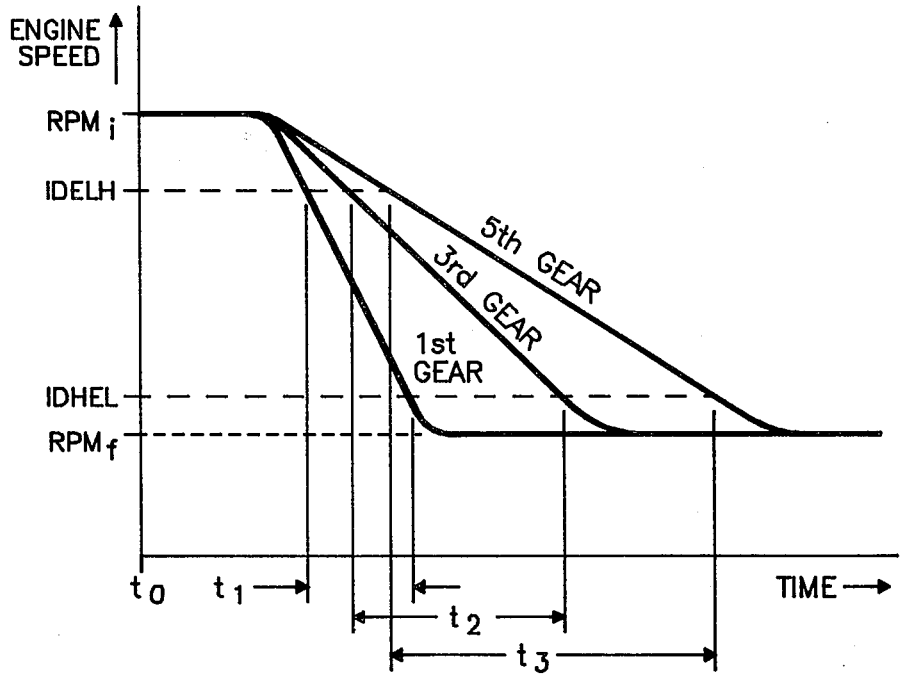
FIG. 1 is a graph illustrating the variation of engine speed as a function of time under various different engine operating conditions (different gears) during deceleration.

Referring to FIG. 1, the engine speed versus time response of an engine during engine deceleration is illustrated for various engine operating conditions. In FIG. 1 the vertical axis represents engine speed, preferably in revolutions per minute (rpm), while the horizontal axis represents elapsed time. FIG. 1 illustrates that at a time $t_0$ the engine has previously obtained a steady state speed of $RPM_0$. At the time $t_0$ the engine throttle, which had previously been depressed to some steady state position, has now been released. FIG. 1 illustrates that at a time subsequent to $t_0$ the engine speed will decrease in accordance with which transmission gear (assuming a manual transmission for the engine) the engine had been operating in. The engine speed will eventually decay to a final engine speed value of $RPM_f$. The term engine idle speed is utilized herein to designate the final steady state engine speed at which the engine will run with the engine throttle in an effective closed position thereby providing only a predetermined minimum amount of fuel to the engine to keep it running in a satisfactory condition.

FIG. 1 illustrates that the rate of decrease of engine speed as a function of elapsed time during engine deceleration varies greatly in accordance with engine operating parameters such as the gear in which the engine is operating. Thus for an engine operating in first gear the elapsed time during deceleration between a predetermined maximum threshold engine speed of IDLEH and a predetermined minimum threshold speed of IDLEL is represented by the time $t_1$. If the engine was operating in third gear the corresponding duration of elapsed time during deceleration corresponds to the time $t_2$ which is greater than $t_1$, while for fifth gear a duration of $t_3$ exists that is greater than the time $t_2$. The significance of the different rates of decrease of engine speed during deceleration is that if, as in prior systems for controlling the decrease of dashpot actuation, the effective actuation of the dashpot is decreased as a fixed function of time commencing when engine speed falls below a threshold such as IDLEH, then the decrease of dashpot actuation can only be designed to track the actual variation of engine speed during deceleration for operation of the engine in any one gear. Thus while FIG. 1 makes it clear that the rate of decrease of engine speed varies greatly for different engine conditions, prior dashpot controls which merely decreased dashpot actuation during deceleration as a direct fixed function of time would either terminate the dashpot actuation too soon or too late depending upon which fixed time function relationship was selected for decreasing dashpot actuation.

Prematurely terminating dashpot actuation results in the generation of excessive hydrocarbons by the engine whereas terminating dashpot operation too late would, under certain operating conditions, result in the control of dashpot actuation delaying the time at which the engine attains it final idle speed $RPM_f$. Both of these adverse effects can be illustrated by assuming that the actuation of the air bypass valve (dashpot), which controls the amount of air added to the engine fuel mixture in addition to the amount of air determined by the actual throttle position, has 100% (full) effective actuation at the speed IDLEH and is decreased to minimum (zero) effective actuation at the speed IDLEL, and that, as in prior systems, the change (decrease) in dashpot actuation is designed to be a substantially fixed function of the elapsed time during deceleration such that the change in actuation tracks the engine response provided for the engine being in a specific gear.

If the decrease in dashpot actuation in prior systems was designed to track the operation of the engine in third gear, then the degree of actuation could decay either linearly or as some other function of time such that during the elapsed time duration $t_2$ actuation varied from 100% to 0. If this was the case, then for the same engine operating in fifth gear, the dashpot actuation would decay prior to engine speed obtaining the minimum predetermined speed of IDLEL or the final idle speed of $RPM_f$. In this case the excessively rapid decrease of dashpot actuation would result in too rich of a fuel mixture as the engine speed approached engine idle and this would result in an excess generation of hydrocarbons for the engine assuming the engine to be a gasoline engine. If the engine was operated in first gear then the decrease of dashpot actuation would not occur rapidly enough.

Figure 2:
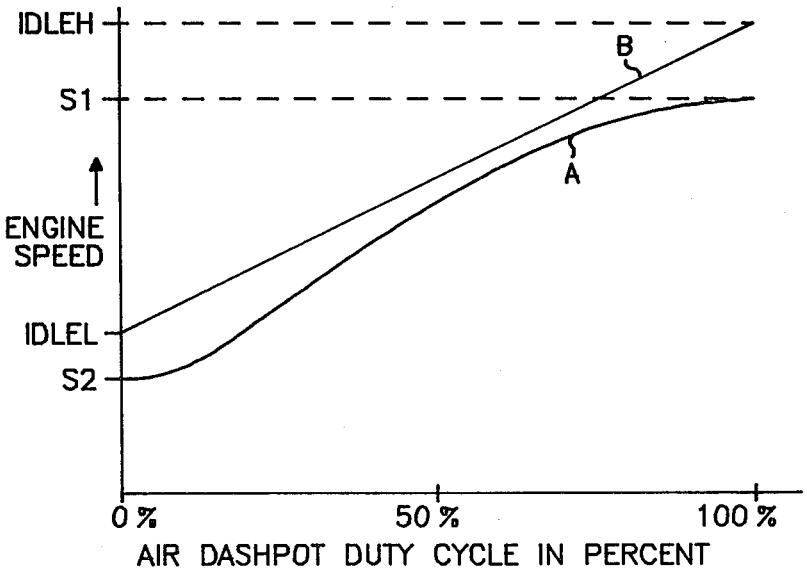
FIG. 2 is a graph illustrating the control apparatus calculated relationship and actual no load engine idle relationship between engine speed and dashpot actuation.

If engine dashpot actuation is a direct fixed function of elapsed time during the engine deceleration, then the decrease of dashpot actuation may not occur rapidly enough. This will effect and delay when the engine will reach its final idle speed. This can be illustrated by referring to FIG. 2 in which graph A represents the no load (engine in neutral) engine idle speed variation provided as a function of the percentage of air dashpot actuation. If the engine is operating under a loaded condition, engine operation curves similar to curve A, but shifted downward, exist. In FIG. 2, the vertical axis is representative of engine speed while the horizontal axis is representative of duty cycle of a dashpot actuation control signal in percent with this corresponding to the effective degree of actuation of the dashpot. Curves A and B in FIG. 2 assume a closed engine throttle.

The curve A in FIG. 2 illustrates that when the throttle is closed and the dashpot has its minimum (0) effective actuation, an engine idle speed of S2 is provided, but that with the dashpot effective actuation being full (100%) a no load engine idle speed of S1 is obtained. This is due to the excess air being provided by the dashpot in its fully actuated condition affecting the no load idle speed at which the engine will run. If the degree of decay of dashpot actuation is calculated such that it will track the engine in third gear, then only after an elapsed time of $t_2$ will 0 dashpot actuation be provided and thereby allow the engine to arrive at its final desired idle speed of $RPM_f$, which would essentially correspond to the speed S2 if the engine was running in neutral. If the engine is operated in first gear, but the control of the decrease of dashpot actuation is designed to match the engine performance in third gear, then the time $t_2$ for arriving at 0 dashpot actuation is too long since this result is desired within the smaller time $t_1$. Thus at the elapsed time of $t_1$ since the dashpot actuation is not yet zero, the dashpot itself will prevent (delay) the engine speed from decreasing to S2. Thus prior systems which either decayed the degree of dashpot actuation directly as a fixed function of time or as a fixed function of the elapsed number of engine revolutions, which is a product function of engine speed times elapsed time, never provided a properly adaptive decrease of the dashpot actuation implemented during deceleration. The present invention has recognized this and, as a solution, proposes to make the decrease of dashpot actuation during engine deceleration independent of elapsed time with the change in the actuation decrease being directly proportional to the change in current engine speed during deceleration.

In all of the systems discussed above, including the present system, it should be noted that the purpose of the air dashpot is to purge the intake manifold of the engine of excessive fuel during deceleration and thus minimize hydrocarbon emissions. This is accomplished through the use of the air dashpot which provides additional air to the air-fuel mixture during deceleration with this additional air being added to the air already provided to the fuel mixture in accordance with the throttle position. The dashpot preferably comprises an air bypass solenoid valve which receives a pulse width modulated actuation signal during the deceleration of the engine and provides a controllable secondary path for air to be drawn into the intake manifold in addition to the air path provided in accordance with throttle position. This excess air encourages vaporization of any excess fuel still present in the engine or fuel injection system caused by the sudden (abrupt) initiation of engine deceleration, and this prevents an over rich fuel mixture and incomplete combustion. While prior systems implemented the dashpot function by turning the air bypass valve on fully during initial deceleration, when the throttle was closed and the engine speed was above an initial speed deceleration limit speed, and then gradually decreased the effective actuation (duty cycle) of the dashpot as a fixed function of time or engine revolutions, these prior systems were inherently not adaptive in matching the actual desired dashpot actuation required for different engine deceleration conditions. The present invention overcomes that deficiency in the following manner.

The present invention utilizes the concept of changing the effectively actuation of the dashpot directly in proportion to current engine speed during engine deceleration. This is illustrated by the graph B in FIG. 2 which defines the desired response of the dashpot actuation as a function of engine speed under engine deceleration conditions.

Graph B in FIG. 2 can be represented by the following statements concerning the desired operation of the present invention. For engine deceleration during which the throttle is effectively closed, for engine speeds above a predetermined speed IDLEH full dashpot actuation (100% duty cycle) is provided. For an effectively closed throttle during engine deceleration with engine speed being equal to or less than a predetermined minimum engine speed of IDLEL, zero effective actuation (0 duty cycle percentage) is provided. For engine speeds between IDLEH and IDLEL the degree of effective dashpot actuation is defined by the equation:

$$ADDC = \frac{(RPM - IDLEL) \times T}{(IDLEH - IDLEL)},$$

where ADDC represents air dashpot duty cycle in percent, RPM represents engine speed, IDLEH and IDLEL are predetermined upper and lower threshold engine speeds and T is the period of an oscillating signal which is to be pulse width modulated so as to provide the desired percentage of air dashpot effective actuation. It should also be noted that if at any time during the deceleration transient, the throttle should be brought out of its effective closed position, then the dashpot actuation should be set to 0, since in that event the fuel mixture should be directly controlled by only the position of the throttle.

Before discussing typical hardware and software embodiments for implementing the desired dashpot actuation control, it should be noted that it is significant in FIG. 2 that IDLEL exceeds the no load engine idle speed S2 provided for 0 dashpot actuation while IDLEH exceeds the engine idle speed S1 provided for 100% dashpot actuation. In addition it is also significant that the curve B is always above the curve A in FIG. 2 for all values of dashpot actuation. This is because in designing a properly operative dashpot control apparatus in accordance with the present invention the effective amount of air bypass actuation determined by the engine fuel mixture control device of the present invention as a function of any particular engine speed during deceleration should always be lower than the degree of actuation of the air bypass valve required to maintain the same engine speed as the no load engine idle speed.

The curves A and B in FIG. 2 illustrate that for any engine speed during deceleration, which speed is represented by a horizontal line in FIG. 2, the calculated amount of air dashpot actuation according to curve B will be less than the air dashpot actuation according to curve A which would result in that speed being the engine idle speed. Thus since the present invention implements the curve B in FIG. 2, when the present invention determines a desired amount of dashpot actuation, this will not result in preventing the normal engine deceleration response from obtaining a lower engine speed according to curve A thus insuring that engine speed continues to decrease during deceleration. If the curves A and B intersected, this would represent a potential latch up position in which the final desired idle speed of S2 might not be obtained. As long as the curve B remains above the curve A in FIG. 2 this condition should not exist.

Figure 3:
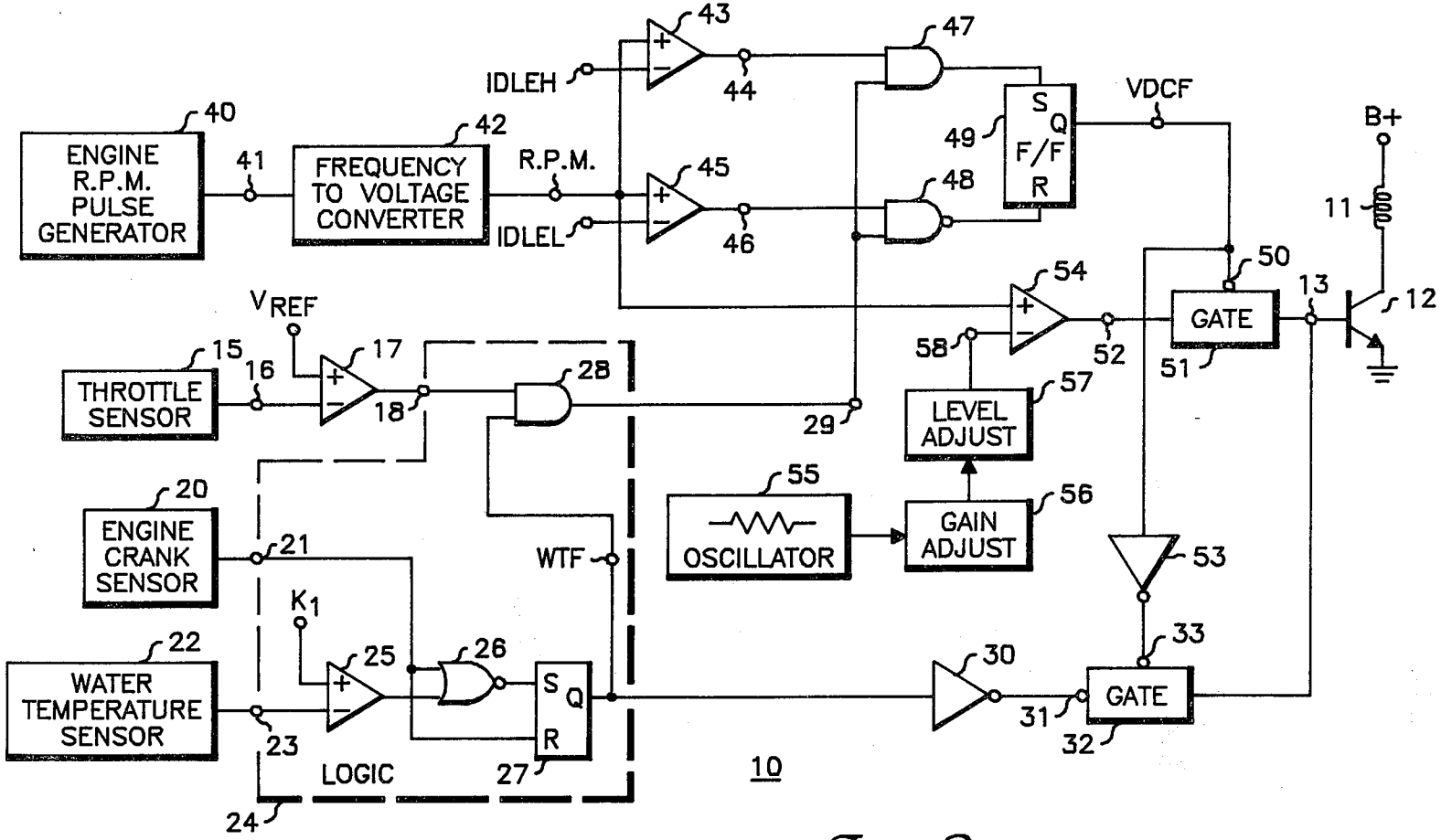
FIG. 3 is a schematic diagram illustrating a typical hardware embodiment for implementing the present invention.
Figure 4:
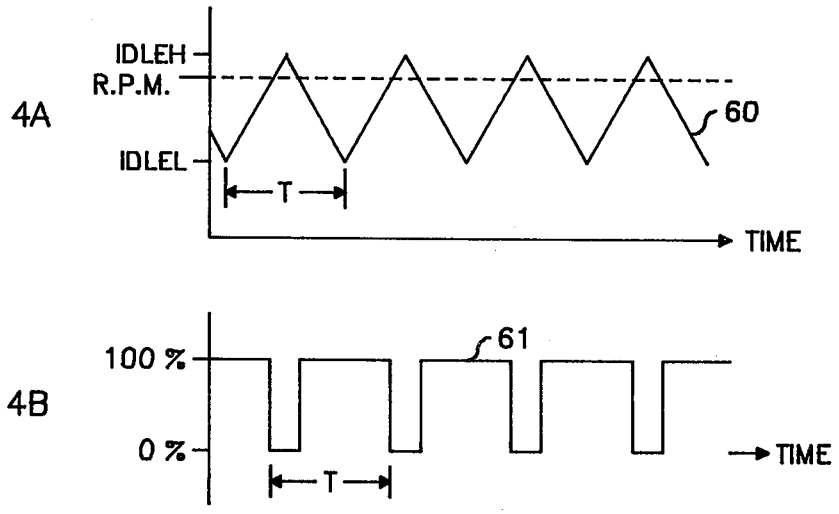
FIG. 4 comprises two graphs, 4A and 4B, illustrating signal waveforms provided by the apparatus in FIG. 3.
Figure 5B:
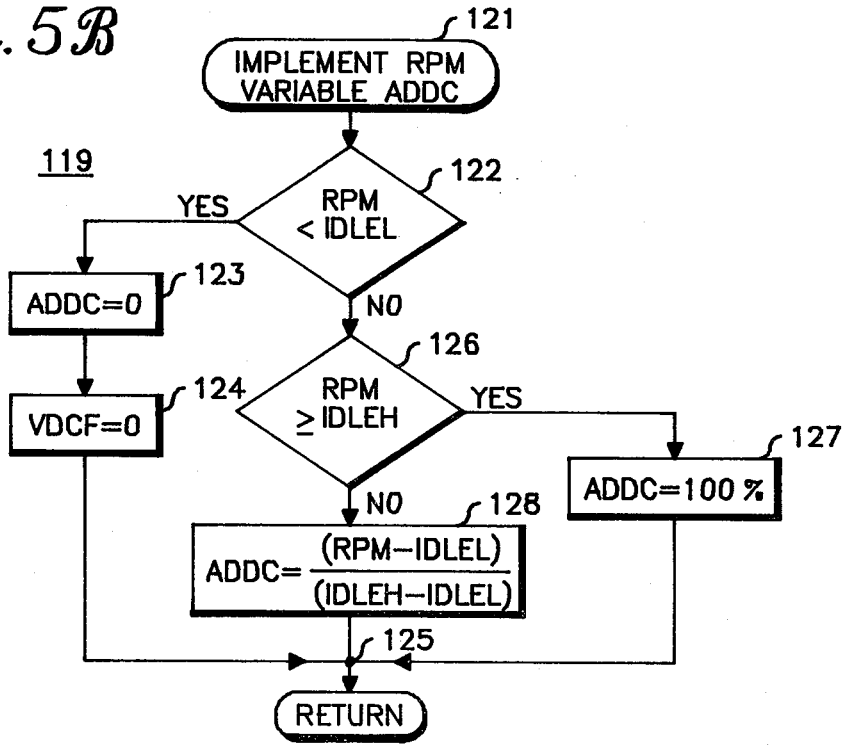
FIGS. 5A and 5B comprise flowcharts illustrating operation of the apparatus in FIG. 3 and a programmed microprocessor implementation of the present invention.
Figure 5A:
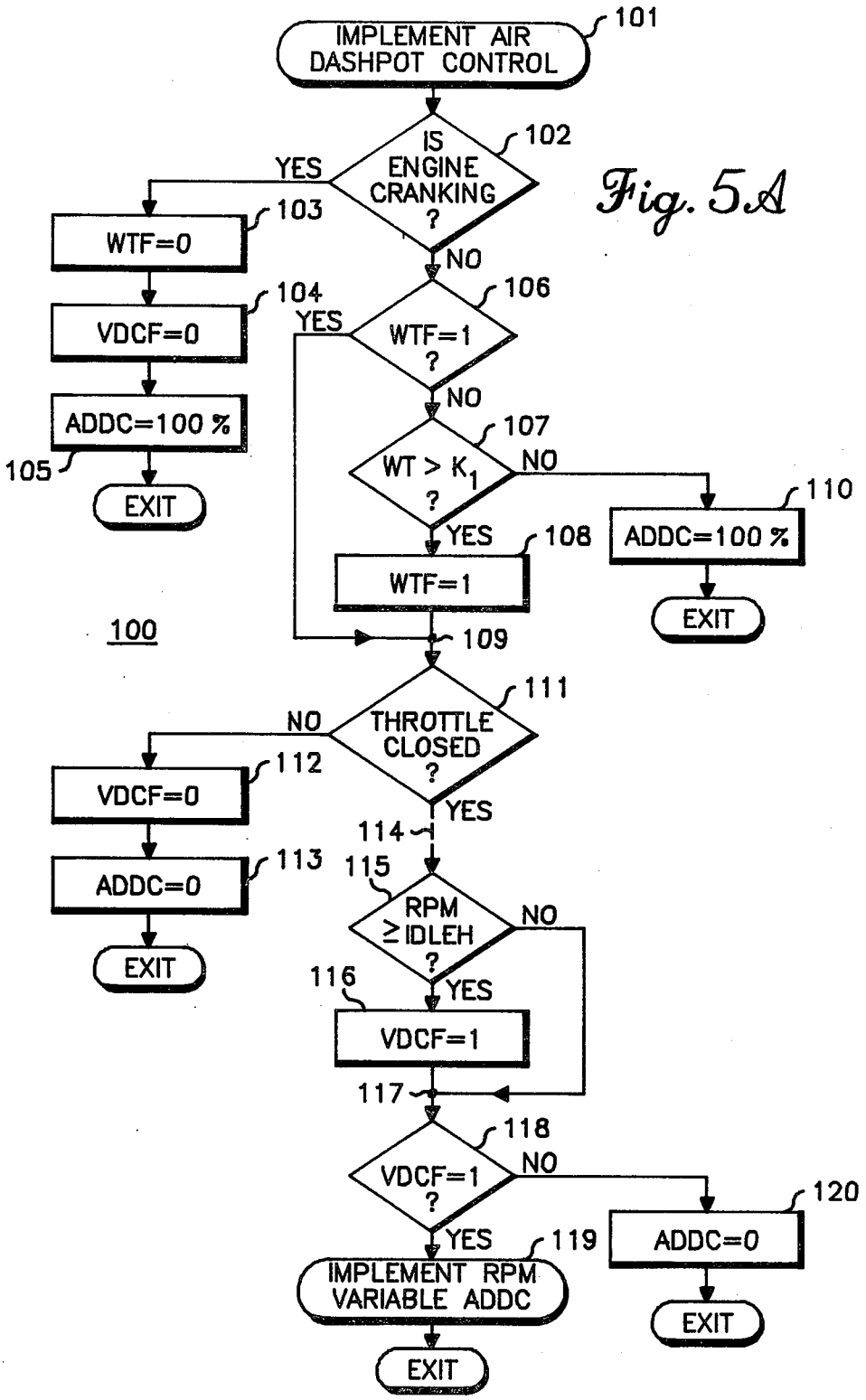

FIG. 3 illustrates a hardware embodiment for the present invention while FIG. 4 illustrates several key signal waveforms associated with the hardware embodiment. The horizontal axes in FIGS. 4A and 4B represents time and the vertical axes represent magnitude. FIGS. 5A and 5B represent flowcharts corresponding to a preferred software (computer program) microprocessor embodiment of the present invention wherein these flowcharts also describe the operation of the apparatus in FIG. 3.

FIG. 3 illustrates an engine fuel mixture control apparatus 10 for controlling the effective on time of an air bypass valve (dashpot) in accordance with the pulsed actuation of a solenoid coil 11 of the dashpot coupled between a B+ terminal and the collector of an NPN transistor 12 having its emitter connected to ground and its base connected to a control terminal 13. The effective degree of actuation of the dashpot is essentially controlled by providing a pulse width modulated control signal at the terminal 13 and varying the duty cycle of this signal between 0 and 100% in order to vary the effective actuation of the dashpot between a minimum effective actuation of 0 and full effective actuation of 100%. The dashpot comprises an on-off air valve (not shown) controlled by the coil 11 and it essentially adds additional air to the fuel mixture in addition to the amount of air which is determined by the position of the engine throttle (not shown) wherein this additional air is selectively added during engine deceleration. Deceleration is defined herein as the transient condition occurring in response to the effective closure of the throttle resulting in the decrease of engine speed from some initial value down to a steady state engine idle speed.

The fuel mixture control apparatus 10 shown in FIG. 3 includes a sensor means for sensing the occurrence of engine deceleration and providing a deceleration occurrence signal in response thereto. This deceleration sensor means essentially includes a throttle position sensor 15 which provides a varying amplitude output signal at a terminal 16 with the amplitude of this signal related to throttle position. Such throttle position sensors may comprise potentiometers having their wiper arms varied in accordance with the position of engine throttle. The terminal 16 is connected to the negative input terminal of a comparator 17 which receives a reference voltage VREF at its positive input terminal and provides an output at a terminal 18.

Essentially, for all throttle positions except a closed throttle position, the components 15 and 17 result in providing a low logic signal corresponding to 0 at the terminal 18, whereas in response to an effective closed throttle position the magnitude of the signal at the terminal 16 will equal that of the reference voltage VREF such that a positive high logic signal at the terminal 18 is provided. Thus the signal at the terminal 18 is indicative of when a closed throttle position occurs. The components 15 through 17 could, if desired, be replaced by a throttle position switch having two output states rather than a throttle position sensor providing a continuous analog signal at the terminal 16 related to the actual throttle position. In either event the elements 15 through 18 comprise a throttle position sensor means which provides a signal indicating when the engine throttle is effectively closed thus indicating a potential engine deceleration condition. The engine will tend to decelerate when the throttle is closed whenever the engine speed prior to throttle closure is above engine idle speed.

In the interest of completness, the fuel mixture control apparatus 10 in FIG. 3 is illustrated as including an engine crank sensor 20 which provides at an output terminal 21 a high logic state when the engine is sensed as being in a cranking mode corresponding to the start up of the engine at a very low engine revolution speed. At all other engine conditions, a low logic signal is provided at the terminal 21. A water temperature sensor 22 is also provided in the control apparatus 10 and essentially provides at an output terminal 23 an analog signal having a magnitude related to the sensed temperature of the engine coolant which typically comprises the water and/or antifreeze coolant mixture for the engine.

The terminals 18, 21 and 23 are connected as logic inputs to a logic circuit 24 (shown dashed) which comprises a DC comparator 25 having its negative terminal directly connected to the terminal 23 and its positive terminal connected to a positive reference voltage level identified by the reference designation $K_1$. The output of the comparator 25 is provided as an input to a NOR gate 26 which also receives an input via a direct connection from the terminal 21. The output of the NOR gate is directly connected to the set terminal of a flip flip 27 which has its reset terminal directly connected to the terminal 21 and has its output terminal Q directly connected to a terminal designated WTF, which is used to signify water temperature flag. The terminal WTF is provided as an input to an AND gate 28 which receives an additional input by virtue of a direct connection to the terminal 18 and provides its output at a terminal 29. The components 25 through 28 comprise the logic circuit 24 and the operation of this circuit will now be discussed.

Essentially the signal at the terminal 23 is compared to the threshold level $K_1$ such that the comparator 25 will provide a 0 output when the water temperature has exceeded a reference water temperature corresponding to the voltage $K_1$. At this time, assuming that the engine is not in its crank mode, the NOR gate will result in setting the flip flop 27 and thereby providing a high logic state at the terminal WTF indicating that the engine is in a non-starting mode and that the water temperature has exceeded some minimum level. In this event, the AND gate 28 now permits the passage of any high logic state present at the terminal 18 to the terminal 29 wherein a high logic state at the terminal 29 indicates the proper non-initializing operation of the engine and the effective closure of the throttle indicating the existence of a potential engine deceleration. The signal at the terminal 29 will essentially be utilized to determine if a variable duty cycle flag (VDCF) is to be set high to effectively enable the air dashpot duty cycle (ADDC) to be varied in proportion with decreasing engine speed during engine deceleration. If the variable duty cycle flag is not set, then either full or 0 effective actuation of the dashpot is provided in a manner to be described.

The terminal WTF is directly connected through an inverter 30 to an input terminal 31 to a controllable gate 32 which has its output directly connected to the terminal 13 and receives control signals at a control terminal 33. If a high logic signal is present at the terminal 33, the gate 32 closes and connects the terminals 31 and 13 and therefore provides control of the actuation of the solenoid coil 11 in accordance with the logic signal provided at the terminal WTF. For a low logic signal provided at the terminal 33, the gate 32 is opened thereby providing no connection between the terminals 31 and 13.

During engine cranking the flip flop 27 will have its output set low and it is contemplated that the gate 32 will be closed such that an effective 100% duty cycle (full actuation) of the dashpot will be implemented. In addition, if the engine coolant temperature has not exceeded a temperature corresponding to the level $K_1$ after the engine has stopped cranking then the logic state at the terminal WTF will remain low and it is contemplated that the gate 32 will be closed also providing for 100% actuation of the dashpot. It should be noted that 100% actuation corresponds to constant full excitation of the coil 11, while zero actuation corresponds to no actuation of the coil. In the event that the water temperature does not exceed the level corresponding to $K_1$ after the engine cranking mode, the flip flop 27 will be set such that a high logic signal will provided at the terminal WTF. In this case, it is contemplated that either the logic gate 32 will be closed providing zero actuation for the dashpot or that a different controllable gate (51) will be closed providing for variable dashpot actuation during deceleration with the change in dashpot actuation being proportional to changes in current engine speed. The manner in which this is accomplished will now be discussed.

The fuel mixture control apparatus 10 includes an engine speed (RPM) pulse generator 40 which comprises a sensor that senses the passage of projections rotated in synchronism with a crankshaft driven by the engine and provides a series of engine speed related pulses in response thereto. These pulses are provided at an output terminal 41 that is connected as an input to a frequency to voltage converter 42 which essentially integrates these signals and provides an analog signal at a terminal RPM wherein the magnitude of this signal is related to current engine speed.

The terminal RPM is directly connected to the positive input terminal of a DC comparator 43 which has its negative input terminal connected to a terminal IDLEH having a reference voltage representative of a maximum threshold engine speed also designated IDLEH. The comparator 43 provides an output at a terminal 44. The terminal RPM is also connected to the positive input terminal of another DC comparator 45 which has its negative input terminal connected to a terminal IDLEL having a reference voltage representative of a minimum threshold engine speed also designated IDLEL. The comparator 45 provides an output at a terminal 46. The terminal 44 is provided as an input to an AND gate 47 while the terminal 46 is provided as an input to a NAND gate 48 with both of the gates 47 and 48 receiving an additional input by virtue of a direct connection to the terminal 29. The output of the AND gate 47 is connected to the set terminal of a flip flop 49 while the output of a NAND gate 48 is connected to the reset terminal. The output of the flip flop 49 is provided at an output terminal VDCF where this letter designation indicates variable duty cycle flag since only if a high logic signal is provided at this terminal will a variable dashpot duty cycle varied in accordance with current engine speed be provided. The terminal VDCF is directly connected to a control terminal 50 of a controllable gate 51 that has its output provided directly to the terminal 13 and receives an input from a terminal 52. The terminal VDCF is also connected through an inverter 53 to the control terminal 33 wherein this results in the complementary on-off operation of the gates 51 and 32.

The terminal RPM is directly connected to the positive input of a DC comparator 54 which has its output directly connected to the terminal 52 and receives an input signal at its negative terminal provided by a fixed frequency triangle wave oscillator 55 providing a signal to a gain adjustment circuit 56 which in turn provides a signal to a level adjustment circuit 57 that directly provides a signal to a terminal 58 directly connected to the negative terminal of comparator 54. Essentially the components 54 through 58 comprise a pulse width modulator for providing a pulse width modulated signal at the terminal 52 in accordance with the current engine speed as represented by the magnitude of the analog speed signal at the terminal RPM. The manner in which this is accomplished can be best understood by refering to the waveforms shown in FIGS. 4A and 4B.

In FIG. 4A a signal 60 is illustrated as being derived from the output of the triangle wave oscillator 55. The signal 60 has a fixed period T. The gain adjustment circuit 56 is utilized to insure that the difference between the peaks and valleys of the signal 60 corresponds to the difference between reference voltages which are provided at the terminals IDLEH and IDLEL in FIG. 3. The level adjustment circuit 57 is utilized to adjust the output of oscillator 55 such that the average between the peaks and valleys of the signal 60 corresponds to the average of the reference voltages at the terminals IDLEH and IDLEL. The signal at the terminal 58 provided as an input to the negative input of the comparator 54 corresponds to the signal 60 as shown in FIG. 4A. In FIG. 4A a dashed reference level designated RPM is illustrated and this reference level represents the engine speed variable analog signal provided at the terminal RPM.

FIG. 4B illustrates a signal 61 provided at the terminal 52 by the DC comparator 54 wherein clearly this signal output comprises a pulse width modulated signal having a duty cycle related to the difference between the engine speed level RPM and the reference voltages IDLEH and IDLEL which correspond to predetermined maximum and minimum engine speeds at which engine deceleration decisions should be made at.

Essentially, if the RPM reference level exceeds IDLEH, the signal 61 in FIG. 4B will have an effective 100% duty cycle whereas if the reference level RPM is below IDLEL the signal 61 will have a 0% duty cycle. For values of RPM between the limits IDLEH and IDLEL interim values of duty cycle expressed as a percentage of the period T will be provided for the signal 61. This is exactly the desired engine speed related variable duty cycle transfer function given by the equation which was discussed previously wherein it was noted that this type of relationship should be used at certain times during engine deceleration to implement a speed related decay of effective dashpot actuation. This is accomplished by the apparatus in FIG. 3 in the following manner.

Once a high logic signal is provided at the terminal WTF, then the AND gate 28 will provide at the terminal 29 a high logic signal output only in response to an effective closed throttle condition. If the throttle is not effectively closed, a low logic signal will be provided at the terminal 29. This will result in the NAND gate 48 resetting the flip flop 49 and insuring that a low logic output is provided at the terminal VDCF. In this event the gate 32 will be closed permitting the WTF signal to control the dashpot actuation by providing for 0 (minimum) dashpot actuation by virtue of the inverter 30.

During the existence of a closed throttle condition, a high logic signal will be provided at the terminal 18, and if this also corresponds to the existence of a high logic signal at the water temperature flag terminal WTF then the terminal 29 will have a high logic state. In this event, the flip flop 49 will be reset if the engine speed signal at the terminal RPM is below the predetermined minimum speed IDLEL corresponding to the reference voltage at terminal IDLEL.

If a high logic signal is provided at the terminal 29, indicating the existence of a potential deceleration condition, and the engine speed exceeds a predetermined maximum engine speed IDLEH corresponding to the reference voltage at terminal IDLEH, then the AND gate 47 will set the flip flop 49 thereby providing a high logic signal at the terminal VDCF. This results in closing the gate 51 while opening the gate 32 such that now the signal at the terminal 52 will control the dashpot actuation. Under these circumstances the signal 61 in FIG. 4B represents the effective actuation control signal for the dashpot, and the apparatus 10 provides for varying in proportion with changes in current engine speed during deceleration the change in the effective duty cycle in a pulsating excitation signal coupled to and controlling the actuation of the dashpot (air bypass valve). This occurs while the engine speed decreases between the predetermined maximum and minimum engine speeds IDLEH and IDLEL. Once the engine speed falls below the minimum speed corresponding to IDLEL, then the NAND gate 48 will reset the flip flop 49 resulting in the gate 32 now providing for constant minimum (0) effective actuation of the dashpot during any further deceleration unless the engine speed thereafter exceeds the maximum engine speed IDLEH.

With the configuration illustrated in FIG. 3 it is clear that minimum effective actuation of the dashpot is provided during engine deceleration for engine speeds which are below the minimum predetermined engine speed IDLEL, and that maximum effective actuation (100%) of the dashpot is provided for engine speeds which are above the maximum predetermined speed IDLEH.

From the foregoing description it can be seen that the apparatus 10 illustrated in FIG. 3 implements the desired variable duty cycle variation of the dashpot during the decay of engine speed which occurs during engine deceleration if the engine speed after throttle closure exceeded the predetermined speed IDLEH. This same result is also preferably provided by a microprocessor implemented software computer program corresponding to the flowcharts illustrated in FIGS. 5A and 5B. The flowcharts also describe the operation of the apparatus 10 shown in FIG. 3. The flowcharts in FIGS. 5A and 5B contemplate controlling dashpot actuation by controlling the excitation of the coil 11.

FIG. 5A illustrates a master flowchart 100 which is entered at an initializing point 101 entitled implement air dashpot control. This signifies that the flowchart 100 represents the entire air dashpot control function corresponding to the operation of the circuit 10. From the initializing terminal 101 information flow passes to a decision block 102 which determines if the engine is in a cranking mode corresponding to the start up of the engine with engine rotation at a very low engine speed provided by a starter motor. If so, an engine water (coolant) temperature flag WTF is set to 0, a variable duty cycle flag (VDCF) is set to 0 and the air dashpot effective duty cycle (ADDC) is set to 100% by process blocks 103, 104 and 105, respectively. Then the flowchart 100 is exited and other engine control calculations are preferably provided by the microprocessor whose software program includes a program corresponding to the flowchart 100. It should be noted that entering the flowchart 100 is contemplated as being repetively accomplished at relatively high rates, wherein this type of operation corresponds to the normal running of engine control programs by microprocessors. In other words the flowchart 100 will be continually run many times in rapid succession while the host microprocessor performs its engine control functions.

If the decision block 102 determines that engine cranking is not occurring, then control passes to a decision block 106 which determines if the water temperature flag has been set. If not, then a decision block 107 inquires if the water temperature has exceeded a reference temperature $K_1$. If so, then a process block 108 effectively sets the water temperature flag and control passes to a summation terminal 109. If the decision block 106 determined that the water temperature flag had been previously set, then information flow would directly pass to the terminal 109. If the decision block 107 determines that water temperature has not yet exceeded the reference temperature $K_1$, then information flow passes to a decision block 110 which implements a 100% duty cycle for dashpot actuation and the flowchart 100 is exited.

From terminal 109 information flow passes to a decision block 111 which determines if the engine throttle is currently effectively closed. If not, this indicates that no abrupt engine deceleration is desired thereby indicating that utilization of the dashpot is not necessary. Thus in this event, information flow passes to a process block 112 which sets the variable duty cycle flag to 0 and then to a process block 113 which insures that the dashpot duty cycle is set to 0. After this the flowchart 100 is exited.

If the decision block 111 determines that the throttle is effectively closed, then information flow passes through a dashed information path 114 to a decision block 115. The dashed path 114 is utilized to emphasize that, if desired, additional flowchart steps may be present either at this stage or later on to implement dashpot duty cycles which are either fixed or are made to vary in accordance with the elapsed time that the transient deceleration state exists. However, as was previously noted, the present invention deals with controlling the dashpot actuation effectively independently of the elapsed time of engine deceleration but in direct proportion to engine speed.

The decision block 115 determines if the current engine speed is above the predetermined maximum threshold speed IDLEH. If so, information flow passes to a process block 116 which sets the variable duty cycle flag and then control passes to a summation terminal 117. If the decision block 115 determines that current engine speed is not above the reference IDLEH, then information flow passes directly to the terminal 117. From the terminal 117 information flow passes to a decision block 118 which determines if the variable duty cycle flag has been set. If so, information flow then passes on to a subroutine 119 entitled implement RPM variable air dashpot duty cycle (ADDC) which will effectively implement changing the magnitude of dashpot actuation in accordance with changes in the magnitude of engine speed. The subroutine 119 is illustrated in detail in FIG. 5B.

If the decision block 118 determines that the variable duty cycle flag is no longer set, then control passes to a process block 120 which sets the air dashpot duty cycle equal to 0 and the flowchart 100 is exited. This latter function performed by decision block 118 and process block 120 corresponds to implementing a 0 dashpot duty cycle and retaining this actuation once an engine speed below a minimum engine speed IDLEL is encountered during deceleration and during the implementation of the subroutine 119. This is because the occurrence of a speed below this minimum engine speed IDLEL results in the subroutine 119 setting the VDCF flag equal to 0. The operation of the subroutine 119 will now be discussed.

The subroutine 119 shown in FIG. 5B comprises an initializing terminal 121 from which information flow passes to a decision block 122 that determines if the current engine speed is below the predetermined minimum speed IDLEL. If so, a process block 123 sets the dashpot duty cycle to 0 and a subsequent process block 124 sets the variable duty cycle flag equal to 0. Then information flow passes to a summing terminal 125 from which information flow then returns to the main flowchart 100.

If the decision block 122 determines that engine speed is not below the minimum predetermined engine speed IDLEL, then information flow passes to a decision block 126 which determines if engine speed is equal to or above the predetermined maximum engine speed IDLEH. If so, then a process block 127 implements a 100% dashpot duty cycle and information flow proceeds to the terminal 125.

If the decision block 126 determines that engine speed is not above the predetermined maximum speed IDLEH, then information flow passes to a process block 128 wherein the air dashpot duty cycle (ADDC) is set equal to the difference between the current engine speed (RPM) minus the predetermined minimum engine speed IDLEL divided by the difference between the predetermined maximum and minimum engine speeds IDLEH and IDLEL. Then information flow continues to the summing terminal 125.

It should be noted that the flowcharts in FIGS. 5A and 5B correspond to the operation of the apparatus 10 in FIG. 3 as well as describing the information flow of a perferred embodiment of the present invention comprising the programming of an engine control microprocessor where both embodiments determine the degree of dashpot actuation desired for any engine condition. Unnecessary details concerning the flowcharts in FIGS. 5A and 5B have been deleted since these details are not believed necessary to the comprehension of the present invention. These additional details comprise such things as the method of treating the remainder that may exist due to the process block 128 such that this remainder is to be compared with some preset level and result in rounding off the air dashpot duty cycle to the next higher or next lower interger value. Such details would only confuse the present invention by tending to obscure it whereas the present flowcharts clearly illustrate the basic concepts claimed herein.

While we have shown and described specific embodiments of this invention, further modifications and improvements will occur to those skilled in the art. One such modification could comprise the developing of a digital instead of analog engine speed signal at the terminal RPM and the use of digital comparators instead of analog DC comparators. All such modifications which retain the basic underlying principles disclosed and claimed herein are within the scope of this invention.

We claim:

1. Engine fuel mixture control apparatus for controlling the effective on time of an air bypass valve (dashpot) which adds additional air to the fuel mixture, in addition to the air determined by throttle position, during engine deceleration, said apparatus comprising:

sensor means for sensing the occurrence of engine deceleration and providing a deceleration occurrence signal in response thereto;

generator means for generating an engine speed signal having a magnitude corresponding to current engine speed; and control means coupled to both said deceleration sensor means and said engine speed generator means for receiving said deceleration occurrence signal and said engine speed signal and for controlling in response thereto, during engine deceleration, the change in the effective degree of actuation of said air bypass valve substantially independently of the time duration of deceleration but substantially in proportion with the change of the magnitude of said engine speed signal.

2. Engine fuel mixture control apparatus according to claim 1 wherein said deceleration sensor means comprises a throttle position sensor means for providing said deceleration occurrence signal in response to sensing when engine throttle is effectively closed.

3. Engine fuel mixture control apparatus according to claim 2 wherein said engine speed generator means includes a speed sensor for providing said engine speed signal by sensing the passage of projections rotated in synchronism with an engine driven crankshaft.

4. Engine fuel mixture control apparatus according to claim 3 wherein said control means provides for varying in proportion with the change of the engine speed signal during deceleration, the change in the duty cycle of a pulsating excitation signal coupled to and controlling the actuation of said air bypass valve.

5. Engine fuel mixture control apparatus according to claim 4 wherein said control means includes circuitry means for providing for minimum effective actuation of said air bypass valve during deceleration for engine speeds, as indicated by said engine speed signal, which are below a predetermined minimum engine speed.

6. Engine fuel mixture control apparatus according to claim 5 wherein said control means includes circuitry means for providing for maximum effective actuation of said air bypass valve during deceleration for engine speeds, as indicated by said engine speed signal, which are above a predetermined maximum engine speed.

7. Engine fuel mixture control apparatus according to claim 6 which includes circuitry means for providing for constant minimum effective actuation once engine speed, as indicated by said engine speed signal, falls below said predetermined minimum speed during deceleration, unless engine speed thereafter exceeds said predetermined maximum engine speed.

8. Engine fuel mixture control apparatus according to claim 6 wherein said minimum predetermined speed exceeds the engine idle speed which exists when engine throttle is effectively closed and said air bypass valve is at said minimum effective actuation.

9. Engine fuel mixture control apparatus according to claim 8 wherein said maximum predetermined speed exceeds the engine idle speed which exists when engine throttle is effectively closed and said air bypass valve is at said maximum effective actuation.

10. Engine fuel mixture control apparatus according to claim 6 wherein during deceleration the effective degree of air bypass valve actuation provided by said control means for any engine speed is always lower than the degree of actuation required to maintain the same engine speed as the engine idle speed during an engine no load condition.

11. Engine fuel mixture control apparatus according to claim 1 wherein said control means is enabled for providing the control of the change of the degree of actuation in proportion to the change in engine speed only if engine speed during deceleration exceeds, at least once during deceleration, a predetermined engine speed.

12. Engine fuel mixture control apparatus according to claim 1 wherein said control means provides for varying in proportion with the change of the engine speed signal during deceleration, the change in the duty cycle of a pulsating excitation signal coupled to and controlling the actuation of said air bypass valve.

13. Engine fuel mixture control apparatus according to claim 12 wherein said control means includes circuitry means for providing for minimum effective actuation of said air bypass valve during deceleration for engine speeds, as indicated by said engine speed signal, which are below a predetermined minimum engine speed.

14. Engine fuel mixture control apparatus according to claim 13 wherein said control means includes circuitry means for providing for maximum effective actuation of said air bypass valve during deceleration for engine speeds, as indicated by said engine speed signal, which are above a predetermined maximum engine speed.

15. Engine fuel mixture control apparatus according to claim 14 which includes circuitry means for providing for constant minimum effective actuation once engine speed, as indicated by said engine speed signal, falls below said predetermined minimum speed during deceleration, unless engine speed thereafter exceeds said predetermined maximum engine speed.

16. Engine fuel mixture control apparatus according to claim 15 wherein said minimum predetermined speed exceeds the engine idle speed which exists when engine throttle is effectively closed and said air bypass valve is at said minimum effective actuation and wherein said maximum predetermined speed exceeds the engine idle speed which exists when engine throttle is effectively closed and said air bypass valve is at said maximum effective actuation.

17. Engine fuel mixture control apparatus according to claim 1 wherein said control means includes circuitry means for providing for minimum effective actuation of said air bypass valve during deceleration for engine speeds, as indicated by said engine speed signal, which are below a predetermined minimum engine speed.

18. Engine fuel mixture control apparatus according to claim 17 wherein said control means includes circuitry means for providing for maximum effective actuation of said air bypass valve during deceleration for engine speeds, as indicated by said engine speed signal, which are above a predetermined maximum engine speed.

19. Engine fuel mixture control apparatus according to claim 18 which includes circuitry means for providing for constant minimum effective actuation once engine speed, as indicated by said engine speed signal, falls below said predetermined minimum speed during deceleration, unless engine speed thereafter exceeds said predetermined maximum engine speed.

20. Engine fuel mixture control apparatus according to claim 18 wherein said minimum predetermined speed exceeds the engine idle speed which exists when engine throttle is effectively closed and said air bypass valve is at said minimum effective actuation and wherein said maximum predetermined speed exceeds the engine idle speed which exists when engine throttle is effectively closed and said air bypass valve is at said maximum effective actuation.

21. Engine fuel mixture control apparatus for controlling the effective on time of an air bypass valve (dashpot) which adds additional air to the fuel mixture, in addition to the air determined by throttle position, during engine deceleration, said apparatus comprising:

sensor means for sensing the occurrence of engine deceleration and providing a deceleration occurrence signal in response thereto;

generator means for generating an engine speed signal having a magnitude corresponding to current engine speed; and control means coupled to both said deceleration sensor means and said engine speed generator means for receiving said deceleration occurrence signal and said engine speed signal and for controlling in response thereto, during engine deceleration, the change in the effective degree of actuation of said air bypass valve substantially independently of the time duration of deceleration but substantially as a function of the change of the magnitude of said engine speed signal.

* * * * *